US007633059B2

(12) United States Patent
Russ, IV et al.

(10) Patent No.: US 7,633,059 B2
(45) Date of Patent: Dec. 15, 2009

(54) MASS SPECTROMETRY SYSTEM HAVING ION DEFLECTOR

(75) Inventors: Charles William Russ, IV, Sunnyvale, CA (US); Robert Keith Crawford, Palo Alto, CA (US); Steven Michael Fischer, Hayward, CA (US)

(73) Assignee: Agilent Technologies, Inc., Santa Clara, CA (US)

( * ) Notice: Subject to any disclaimer, the term of this patent is extended or adjusted under 35 U.S.C. 154(b) by 301 days.

(21) Appl. No.: 11/580,369

(22) Filed: Oct. 13, 2006

(65) Prior Publication Data

US 2008/0087809 A1 Apr. 17, 2008

(51) Int. Cl.
*H01J 49/26* (2006.01)

(52) U.S. Cl. ..... 250/281; 250/282; 250/283

(58) Field of Classification Search ..... 250/281, 250/282, 292, 294, 296, 283, 299, 397, 300, 250/252.1

See application file for complete search history.

(56) References Cited

U.S. PATENT DOCUMENTS 4,810,882 A * 3/1989 Bateman ..... 250/281
4,851,669 A * 7/1989 Aberth ..... 250/281
5,026,987 A 6/1991 Bier et al.
5,420,425 A 5/1995 Bier et al.
5,464,975 A 11/1995 Kirchner et al.
5,878,405 A 3/1999 Grant et al.
6,274,866 B1 * 8/2001 Li ..... 250/287
6,570,153 B1 5/2003 Li et al.
6,627,877 B1 9/2003 Davis et al.
6,707,034 B1 3/2004 Yamaguchi et al.
6,737,644 B2 5/2004 Itoi
6,797,950 B2 9/2004 Schwartz et al.
6,900,430 B2 * 5/2005 Okumura et al. ..... 250/281
6,914,242 B2 7/2005 Mordehai
2003/0042415 A1 3/2003 Hager
2003/0226963 A1 12/2003 Cooks et al.
2004/0149903 A1 8/2004 Wang
2004/0217272 A1 11/2004 Horning et al.
2004/0245451 A1 12/2004 Schwartz
2007/0045527 A1 * 3/2007 Ogawa et al. ..... 250/281

* cited by examiner

*Primary Examiner*—Kiet T Nguyen

(57) ABSTRACT

A tandem mass spectrometer and method for calibrating a tandem mass spectrometer. The tandem mass spectrometer comprises first and second mass analyzers. The first and second mass analyzers form an ion path. The second mass analyzer is positioned downstream from the first mass analyzer and is arranged to receive ions from the first mass analyzer. An electrode arrangement positioned between the first and second mass analyzers. The electrode assembly is configured to selectively deflect ions from the ion path.

18 Claims, 6 Drawing Sheets

MASS SPECTROMETRY SYSTEM HAVING ION DEFLECTOR

BACKGROUND

A mass spectrometer is used to determine the composition of a sample and involves measuring the mass-to-charge ratios and quantities of ions within the sample. One type of mass spectrometer is a tandem or MS/MS mass spectrometer, which has two or more mass analyzers that are arranged in series along an ion path and work in stages. The tandem mass spectrometer also includes ion optics for focusing and propelling the ions along the ion path and between the ion source and each of the mass analyzers.

In a typical tandem mass spectrometer, for example, a sample of material is ionized to form precursor ions. The ions travel into a first mass analyzer that preselects precursor ions having mass-to-charge ratios within a certain range. The precursor ions are then fragmented into product ions. The product ions pass through ion optics that focus and shapes the ion stream so that it conforms to the size and shape of the entrance for the second mass analyzer. The product ions are detected by a detector in the second mass analyzer. The detector outputs a signal embodying information about the ions that it detects.

A problem is that the ions traveling along the ion path tend to repel each other and spread out or diverge from the ion path. Additionally, the ion optics may not precisely shape the ion beam to conform to the shape of the slit. As a result, many of the product ions in the ion stream strike the electrode plate and do not pass through the entrance slit. The transmission efficiency of product ions through the entrance slit of the second mass analyzer can be as low as 5% to 25%, which results in the detector in the second mass spectrometer outputting an information signal having a relatively low amplitude.

Another difficulty relates to noise. In mass spectrometers, both background ions and the ions of interest for analysis may reach the detector. The background ions that reach the detector cause chemical noise that makes it more difficult to pick out and identify the ions of interest. Tandem mass spectrometers improve the filtering of background ions and particles and have a low level of chemical noise, but this improved filtering and ion selection also results in fewer ions reaching the detector. As a result, the amplitude of the information signal output by the detector in the second mass analyzer is further reduced. The problem is that the detector in the second mass analyzer also outputs electrical noise, which is an electrical signal other than the information signal. Noise is a particular problem because the amplitude of the signal output by the detector is proportional to the number of ions striking it. When so few ions reach the detector, it outputs a low signal and the ratio between the signal and the noise (S/N ratio) is very low. The signal can be in effect drowned out by the noise and is more difficult to process.

Additionally, it is necessary to tune and calibrate the mass analyzers. However, the detection circuits for each of the mass spectrometers in a tandem mass spectrometer may not be mismatched (a continuous detection for the quad vs. a pulsed detector for the TOF) with one another. An example is a tandem mass spectrometer in which the first mass analyzer is a scanning quadrupole mass spectrometer and the second mass analyzer is a pulsing time-of-flight mass spectrometer. Mismatched detection schemes can make calibration of the first mass analyzer time consuming, difficult, and even misleading.

SUMMARY

In general terms, this patent relates to a detector that detects ions selectively deflected from the ion path of a tandem mass spectrometer to an ion detector positioned between first and second mass analyzers.

An aspect is a tandem mass spectrometer comprises a first mass analyzer and a second mass analyzer. The first and second mass analyzers form an ion path, and the second mass analyzer is positioned downstream from the first mass analyzer and is arranged to receive ions from the first mass analyzer. An electrode system is positioned between the first and second mass analyzers and is configured to selectively deflect ions from the ion path for detection.

Another aspect is a tandem mass spectrometer comprises a first mass analyzer and a second mass analyzer. The first and second mass analyzers form an ion path, and the second mass analyzer is positioned downstream from the first mass analyzer and is arranged to receive ions from the first mass analyzer. An electrode system having first and second modes, wherein the ions travel along the ion path to the second mass analyzer when the electrode system is in the first mode and the ions are deflected off the ion path when the electrode system is in the second mode.

Another aspect is a method of adjusting a tandem mass spectrometer. The tandem mass spectrometer defines an ion path. The method comprises passing ions along an ion path from a first mass analyzer and toward a second mass analyzer; selectively deflecting ions off the ion path and to an ion detector before they reach the second mass analyzer; detecting an ion signal; adjusting the first mass analyzer; and passing ions traveling along the ion path into the second mass analyzer when the ion signal is optimized.

Another aspect is a tandem mass spectrometer comprising an ion source configured to generate a plurality of ions. A first mass analyzer is arranged to receive ions from the ion source. The first mass analyzer has a multipole mass filter configured to pass ions within a range of mass-to-charge ratios. A second mass analyzer is arranged to receive ions from the first mass analyzer. The first and second mass analyzers form an ion path. An ion detector is positioned between the multipole mass filter and the second mass analyzer. The ion detector has a conversion dynode arranged to selectively receive ions from the ion path and deflect them to an electron detector. A power supply is in electrical communication with the multipole mass filter. A computer is arranged to receive data from the ion detector and programmed to determine an ion signal for at least one of the mass-to-charge ratios within the range of mass-to-charge ratios.

DETAILED DESCRIPTION

Figure 1:
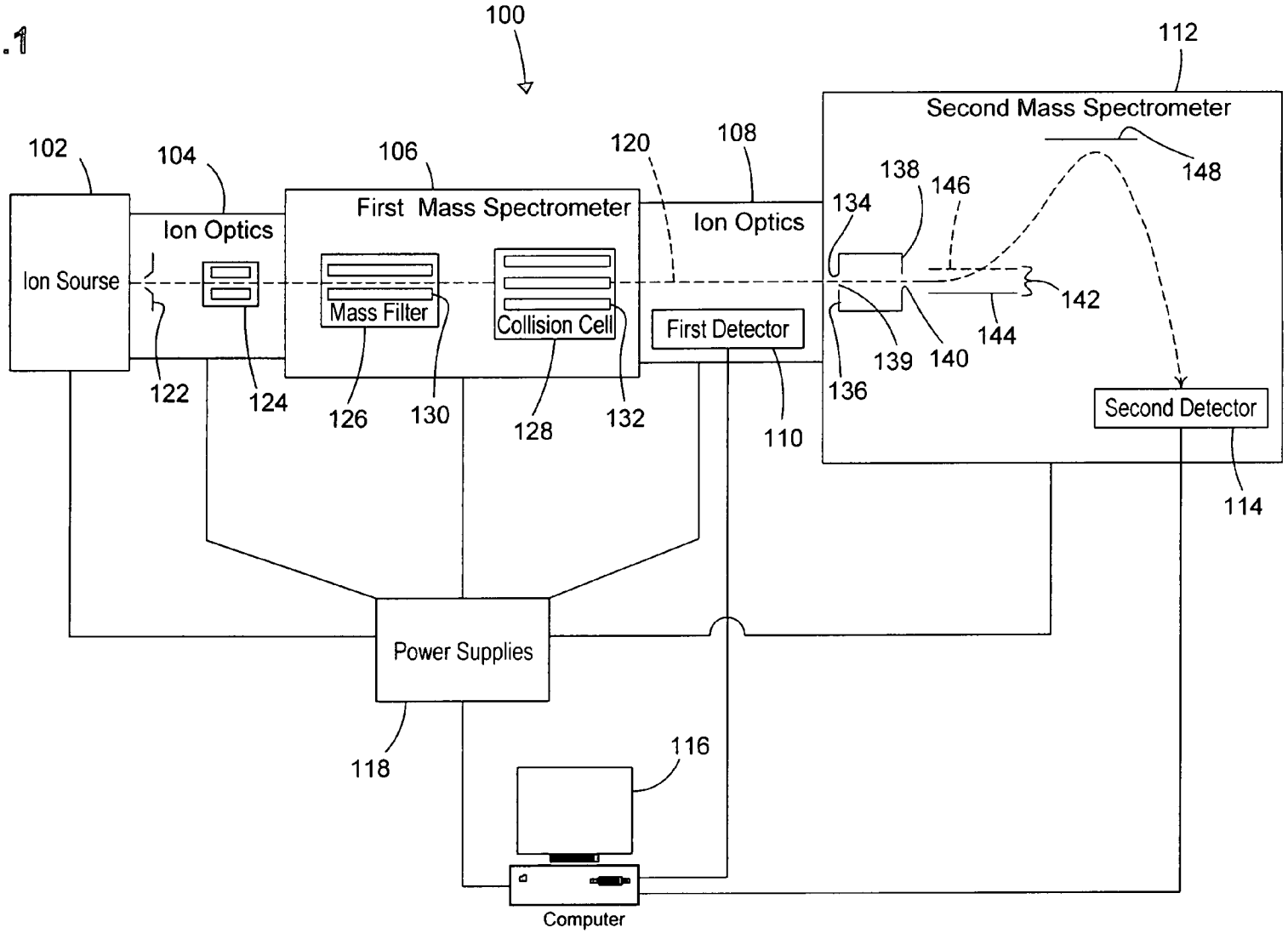
FIG. 1 is a block diagram illustrating an exemplary embodiment of a tandem mass spectrometer that includes ion optics and an ion detector positioned between first and second mass analyzers.

Various embodiments will be described in detail with reference to the drawings, wherein like reference numerals represent like parts and assemblies throughout the several views. Reference to various embodiments does not limit the scope of the claims attached hereto. Additionally, any examples set forth in this specification are not intended to be limiting and merely set forth some of the many possible embodiments for the appended claims.

Referring now to FIG. 1, an exemplary embodiment of a tandem mass spectrometer 100 includes an ion source 102, first arrangement of ion optics 104, a first mass analyzer 106, a second arrangement of ion optics 108 having a first ion detector 110, a second mass analyzer 112 having a second ion detector 114, a computer 116, and power supplies 118. These components can be arranged in a single housing, separate housings, or combinations thereof. The first and second mass analyzers 106 and 112 are cooperatively coupled and operate in conjunction with one another, and in alternative embodiments, the tandem mass spectrometer 100 can include more than two mass spectrometers.

The tandem mass spectrometer 100 defines an ion path 120 that extends from the ion source 102 to the second ion detector 114 in the second mass analyzer 112. The portion or the path proximal to the ion source 102 is upstream and the portion proximal to the second ion detector 114 is downstream. Ions output from the ion source 102 travel along the ion path 120. Ions having a mass-to-charge ratio (m/z) within a selected range of mass-to-charge ratios travel along the ion path 120 to the second detector 114. Ions that do not have a mass-to-charge ratio within the selected range are deflected from the ion path 120 so they do not reach the second detector 114. Additionally, the exemplary ion path 120 is illustrated as having a particular direction or trajectory. The ion path 120 in various embodiments can include any direction or trajectory that passes the ions from the ion source 102, through the first mass analyzer 106, and to the second detector 114 in the second mass analyzer 112.

The ion source 102 ionizes analyte molecules from a sample that can be in a solid, liquid, or gas phase. The ionized analyte molecules are then charged to form ions, including positive (cations) and negative (anions) ions. The tandem mass spectrometer 100 operates in either positive mode and detects cations converted to electrons, or negative mode and detects anions converted to cations. The electric fields direct them into the first arrangement of ion optics 104. The ion source 102 can be any type of source that ionizes analyte molecules. Examples include matrix-assisted laser desorption ionization (MALDI), electrospray (ESI), electron impact (EI), chemical ionization (CI) ion sources, and combinations thereof.

The first arrangement of ion optics 104 receives the ions from the ion source 102, focuses them onto the ion path 120, and passes them into the first mass analyzer 106. In an exemplary embodiment, the first arrangement of ion optics 104 includes a skimmer 122 and a multipole ion guide 124 such as an octopole ion guide formed with eight short electrode rods, although other electrode configurations can be used to form the ion guide. The skimmer 122 collimates the ions into an ion stream flowing along the ion path 120. The multipole ion guide 124 receives the collimated ion stream, provides radial confinement of the ions substantially centered on the ion path 120, and stabilizes the ions within the ion stream. In one possible embodiment, for example, the multipole ion guide 124 adjusts the phase and frequency of the ions so that they enter the first mass analyzer 106 at predetermined levels.

While certain components (e.g., skimmer 122 and multipole ion guide 124) are illustrated in the exemplary embodiment, other embodiments of the first arrangement of ion optics 108 can include more or fewer structures, components, and actions than those illustrated and described herein.

In an exemplary embodiment, the first mass analyzer 106 is positioned downstream and in series with the first arrangement of ion optics 104. The first mass analyzer 106 includes a quadrupole mass ion filter 126 and a collision cell 128. The quadrupole mass ion filter 126 includes four electrode rods 130 that are operated as a mass filter. Both RF and DC voltages are applied to the electrode rods 130 to generate an electric field that envelops the portion of the ion path 120 passing through the electrode rods 130. The electric field passes ions having the selected mass-to-charge ratios along the ion path 120 and toward the collision cell 128. The ratio between the RF and DC voltage potentials applied to the electrode rods 130 allows only ions with a certain mass-to-charge ratio, or a small range of ratios, to pass all the way through the quadrupole mass ion filter 126 along the ion path 120. Ions not within the small range of mass-to-charge ratios are deflected off the ion path 120 and typically strike one of the electrode rods 130 where they are neutralized. The ions that are deflected from the ion path 120 do not reach the collision cell 128. In operation, the power supplies 118 are designed to vary the ratio between the DC and RF voltage potentials through a range of values, which allows ions with a range of mass-to-charge ratios to pass through the quadrupole mass ion filter 126.

In the exemplary embodiment, the collision cell 128 is formed with a hexapole arrangement of electrode rods 132. The electrode rods 132 are excited with an RF voltage that creates an electric field that envelops at least a portion of the portion of the ion path The electric field propels the ion stream along the ion path 120 and provides radial confinement to keep the ions centered on the ion path 120 as they are propelled through the collision cell 128.

The hexapole is positioned in a chamber that includes a gas inlet. The chamber is filled with an inert gas such as nitrogen or argon. As ions travel along the ion path 120 they strike molecules from the inert gas and fragment creating product ions. The product ions, and any ions that are not fragment, exit the collision cell 128 and pass into the second arrangement of ion optics 108. In alternative embodiments, structures that fragment ions are used in place of or in addition to the collision cell 128.

Alternative embodiments of the first mass analyzer 106 are possible. For example, the quadrupole mass ion filter 126. The first mass analyzer 106 can also have other configurations such as an ion trap or any other type of assembly that can serve as a mass spectrometer. Additionally, the collision cell 128 can include any suitable electrode arrangement, can use any suitable gas for fragment ions, and can be positioned adjacent to the first mass analyzer 106 (as illustrated in the exemplary embodiment) or downstream from the first mass analyzer 106. Yet other possible embodiments of the tandem mass spectrometer 100 do not include a collision cell 128.

The second arrangement of ion optics 108 is positioned downstream and in series with the first mass analyzer 106. The second arrangement of ion optics 108 carries the ions (including product ions and any ions traveling along the ion path 120 that are not fragmented in the collision cell 128) from the first mass analyzer 106 to an entrance 139 of the second mass analyzer 112. The second arrangement of ion optics 108 includes electrodes that focus and shape the ion stream to conform to the entrance 139 of the second mass analyzer 112, which is described in more detail herein. The exemplary embodiment of the second arrangement of ion optics 108 also includes the first ion detector 110 for detecting ion signals from ions that are selectively diverted from the ion path 120. The first ion detector 110 is positioned between the first mass analyzer 106 and the second mass analyzer 112, and is positioned to receive ions deflected from the ion path 120. Other embodiments might position the first ion detector 110 in different locations with respect to the electrodes in the second arrangement of ion optics 108 or in locations other than within the second arrangement of ion optics 108.

In the exemplary embodiment, the second mass analyzer 112 is a time-of-flight mass spectrometer and is positioned downstream from and in series with the second arrangement of ion optics 108. The entrance 139 to the second mass analyzer is formed by a slit 134 or other aperture defined in an electrode plate 136. One or more additional electrode plates 138 defining slits 140 or other apertures can be positioned in series with the entrance 139 or form a part of the entrance 139. An ion modulator 142 formed with parallel electrodes, one a plate 144 and the other a grid 146, is positioned along the ion path 120 and downstream from the electrode plates 136 and 138 forming the entrance 139 to receive ions traveling through the slits 134 and 140. The ion modulator 142 collects ions and periodically generates a pulsed electric field that releases a packet of ions to continue traveling along the ion path 120. The released ion packet travels along the ion path 120 toward an ion mirror 148, which is an electrode assembly that generates a reflector or electric field that deflects the ions toward the second ion detector 114. Ions within the ion packet travel along the ion path 120 and separate according to their mass-to-charge ratios.

In an exemplary embodiment, the second detector 114 is a microchannel plate (MCP) detector. The MCP detector includes a plate formed with glass capillaries lined with an electron-emissive material. The ions in the ion pack strike the glass capillaries, which create an avalanche of electrons from the electron emissive material. The mass-to-charge ratio of the ions in the packet are then detected from the time-of-flight between the time the ion packet is released from the ion modulator 142 and the time that ions are detected at the MCP detector.

Although the exemplary embodiment includes an MCP detector, the second detector 114 can include any type of detector that detects ions. Additionally, the second mass analyzer 112 can be a time-of-flight mass spectrometer having components and configurations different from the exemplary embodiment as described herein. The second mass analyzer 112 also can define the ion path 120 to have any shape or trajectory that extends from the entrance 139 to the second detector 114. The second mass analyzer 112 also can be a mass spectrometer other than a time-of-flight mass spectrometer.

The computer 116 is in electrical communication with the first and second detectors 110 and 114, power supplies 118, and any other controls for the tandem mass spectrometer 100. The computer 116 has any suitable platform and operating system and includes a monitor for displaying data. An exemplary platform is a general purpose computer that includes a Pentium®-brand dual-core processor, although other types of circuitry can be used. Additionally, the platform can have any suitable configuration such as a desk-top computer, portable or notebook computer, a hand-held computer, a tablet PC, and a mainframe. Other embodiments have a dedicated control and/or data acquisition system in place of or in complement to a general purpose computer. The computer 116 also can have any suitable operating system such as the WINDOWS®-, UNIX®-, or LINUX®-brand operating systems.

In some possible embodiments, the computer 116 may have a network interface to communicate data and control signals with servers and/or other computers, whether the network is a local-area network, an Intranet, or the Internet. Additionally, the computer 116 can include drivers and interfaces (e.g., RS-232 port) to communicate with and control power supplies 118 and other control circuits.

The computer 116 is programmed to acquire data output by the first and second detectors 110 and 114. In one possible embodiment, the computer 116 also analyzes the data and presents the data on the monitor or prints the data. In other embodiments, the computer 116 controlling the tandem mass spectrometer 100 communicates data acquired from the first and/or second detector 10 and/or 114 to another computer for processing and analysis.

Additionally, the computer 116 controls the power supplies 118 that provide power to the electrodes in the various components of the tandem mass spectrometer 100 including the ion source 102, the first and second arrangement of ion optics 104 and 108, and the first and second mass analyzers 106 and 1112. In some embodiments, the computer 116 also interfaces with any other controls operating the tandem mass spectrometer 100. Additionally, other embodiments may include two or more computers.

Figure 2A:
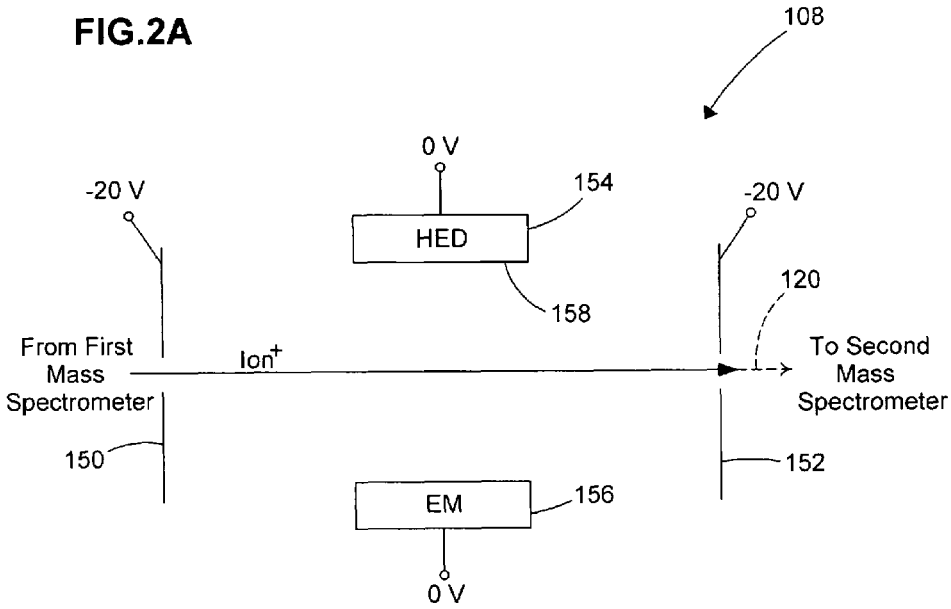
FIGS. 2A and 2B are block diagrams illustrating an exemplary embodiment of the ions optics and ion detector positioned between the first and second mass analyzers.
Figure 2B:
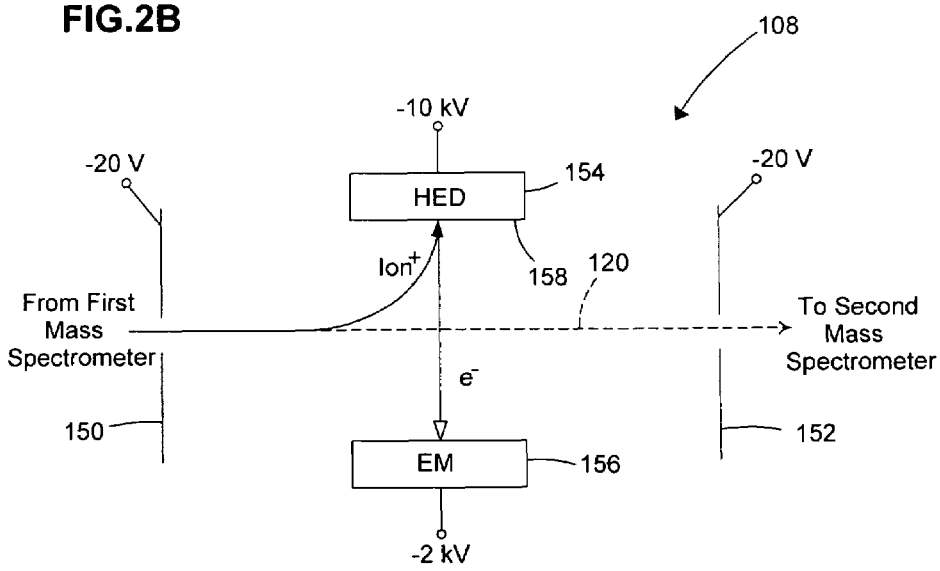

FIGS. 2A and 2B illustrate an exemplary embodiment of the second arrangement of ion optics 108. FIG. 2A illustrates the second arrangement of ion optics 108 and the first detector 110 when the tandem mass spectrometer 100 is in an operation mode. FIG. 2B illustrates the second arrangement of ion optics 108 and the first detector 110 when the tandem mass spectrometer 100 is in a calibration mode.

The ion optics 108 includes first and second ion lenses 150 and 152. The first and second ion lenses 150 and 152 shape the ion stream to conform to the shape of the entrance slit 140 of the second mass analyzer 112, and focus and steer the ion stream into the entrance 139 of the second mass analyzer 112. The first and second ion lenses 150 and 152 are formed with assemblies of electrode plates, although the first and second ion lenses 150 and 152 can include any structure and assembly of electrodes that shape, focus, and/or steer the ions. In the exemplary embodiment, the first and second lenses 150 and 152 are excited with about 20 Volts DC, although any combination and level of DC and RF voltages can be applied to the first and second ion lenses 150 and 152 that shape, focus, and ion steer the ion stream.

The first detector 110 is positioned to selectively receive ions that are deflected from the ion path 120. In the exemplary embodiment, the first detector 110 is a point detector such as a Daly-type detector, which includes metal that emits secondary electrons when struck by an ion. The first detector 110 is formed with a conversion dynode such as a high-energy dynode (HED) 154 and is positioned on one side of the ion path 120 and an electron multiplier 156 is positioned on an opposite side of the ion path 120 to receive electrons emitted from the HED 154.

When in the operational mode as illustrated in FIG. 2A, there is no voltage or bias applied to either the HED 154 or the electron multiplier 156. The HED 154 is in an unbiased state. In this mode, the ion stream passes along the ion path 120 from the first mass analyzer 106, through the first and second lenses 150 and 152, and into the second mass analyzer 112.

When in the calibration or tuning mode as illustrated in FIG. 2B, DC voltages are applied to the HED 154 and the electron multiplier 156, which cause them to generate an electric field. The HED 154 and electron multiplier 156 are in a biased state. The DC voltage applied to the HED 154 is greater than the DC voltage applied to the electron multiplier 156. As ions pass through the first lens 150 and enter the electric field, they are deflected or diverted off the ion path 120 and bombard a surface 158 of the HED 154. The impact of the ions frees or releases electrons from the HED 154, which then emits one or more electrons. The freed electrons travel to and bombard the electron multiplier 156.

The electron multiplier 156 outputs a signal indicative of the number of electrons that it detects, which corresponds to the number of ions that strike the HED 154. In one embodiment, the electron multiplier 156 outputs an electrical current, measured by an electrometer, the amplitude of which corresponds to the number of detected electrons. In an alternative embodiment, the electron multiplier 156 outputs a digital pulse for each electron that it detects.

Figure 3:
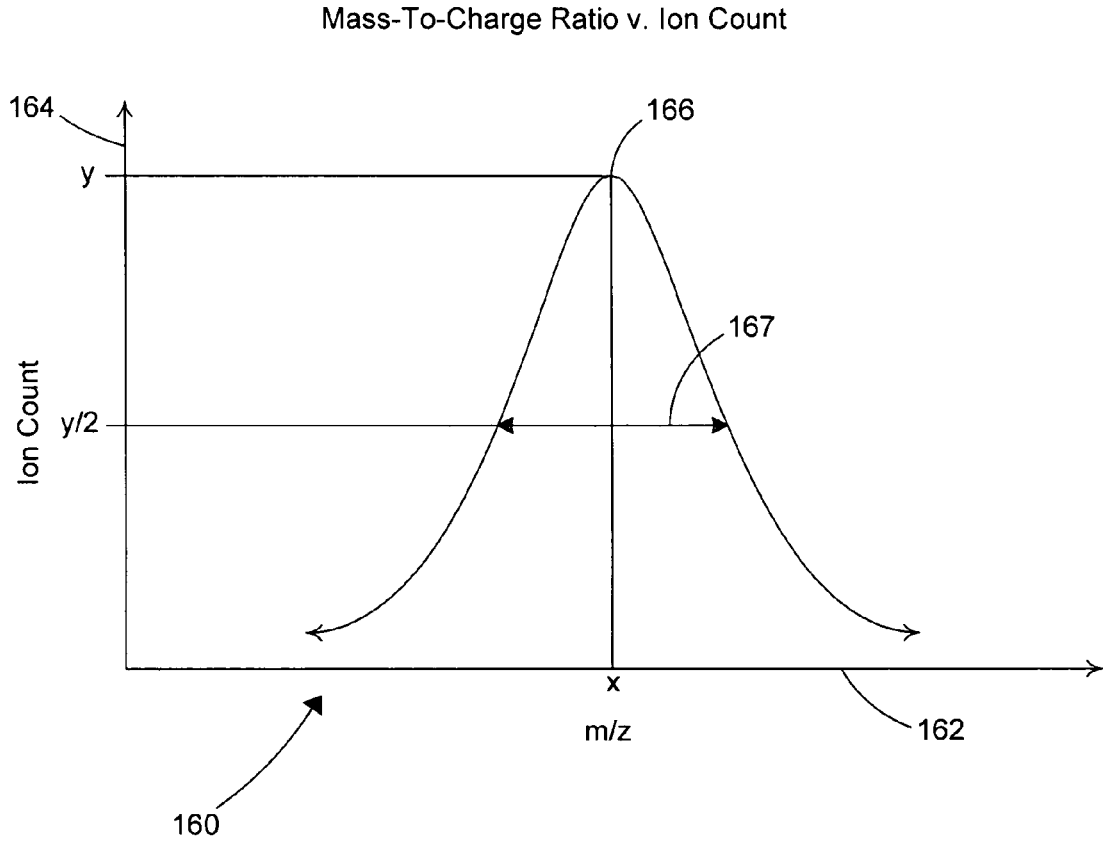
FIG. 3 illustrates a plot of data collected from the ion detector.

The computer 116 acquires the data generated by the first detector, and then determines and presents the count of ions detected at each mass-to-charge ratio. Referring to FIG. 3, a possible format to present the ion count is a Gaussian curve 160 displaying the distribution of mass-to-charge ratios 162 versus the ion count 164. The ion count at each mass-to-charge ratio corresponds to the number of ions that traveled through the quadrupole mass ion filter 126 at a given ratio between the DC and RF voltage potentials. The peak 166 of the exemplary curve 160 corresponds to the mass-to-charge ratio of interest. For example, the mass-to-charge of interest has a mass-to-charge ratio of x and an ion count of y, which corresponds to the peak 166. The width of the peak 166 at one half of the ion count (y/2) is the full-width half maximum (FWHM) or peak width 167. The FWHM 167 presents a tradeoff for the tandem mass spectrometer 100. The wider the FWHM 167, the more signal or better sensitivity of the first mass analyzer 106. The narrower the FWHM 167, the better selectivity of ions at the desired mass-to-charge ratio, x.

Although a plot 160 is illustrated in the exemplary embodiment, other embodiments present the ion count and/or other data in other formats. For example, the ion counts and related mass-to-charge ratios can be presented in a table. Different embodiments might present the ion counts at all of the mass-to-charge ratios or at only select mass-to-charge ratios. Yet other embodiments might present the count relative to parameters (e.g., frequency) other than the mass-to-charge ratio. If the calibration is automatic, other embodiments might not display or otherwise present the ion count during the calibration process at all.

Figure 4:
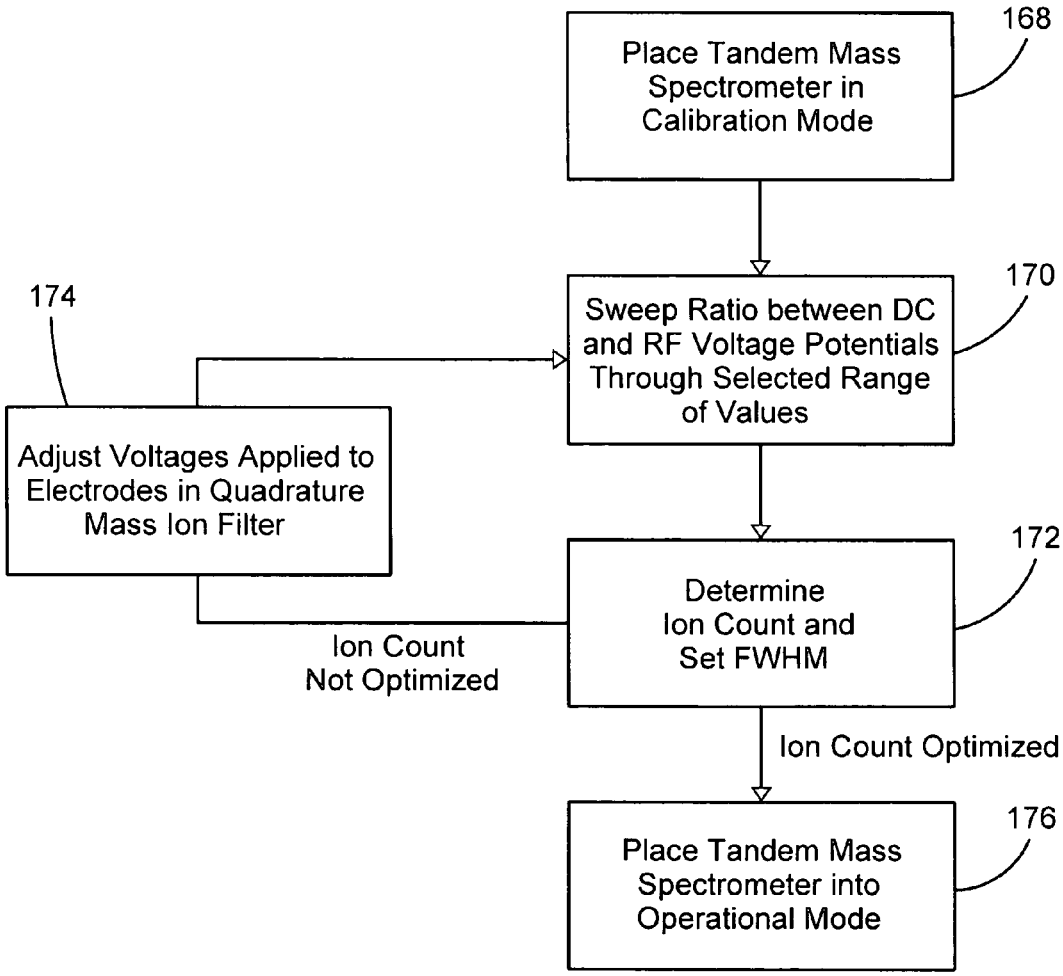
FIG. 4 is flowchart illustrating operation of the tandem mass spectrometer.

FIG. 4 illustrates the sequence of operations when calibrating or tuning the mass filter. In operation 168, the tandem mass spectrometer 100 is placed in the calibration mode, and ions from a sample are input from the ion source 102 to the first arrangement of ion optics 104 and the ion path 120. In one possible embodiment, the ion source 102 provides ions from a sample having a known composition. Operation 170 sweeps through a selected or predetermined range of ratios between DC and RF voltage potentials. Ions having a mass-to-charge ratio corresponding to the selected range of ratios between DC and RF voltage potentials travel along the ion path 120, through the quadrupole mass ion filter 126, and to the first ion detector 110. The remaining ions are deflected from the ion path 120.

At operation 172, the computer 116 determines the ion count by mass-to-charge ratios for ions that reach the first detector 110. The first mass analyzer 106 is then tuned or calibrated at operation 174 by adjusting the voltages applied to the electrode rods 130 to optimize the ion count for the desired mass-to-charge ratio. The first mass analyzer 106 is also calibrated to set the FWHM 176 to a desired width to balance between the desired sensitivity of the first mass analyzer 106 and selectivity of ions having the desired mass-to-charge ratio. The voltages can be adjusted by adjusting the DC voltage potential, the RF voltage potential, the ratio between the DC and RF voltage potentials, the frequency of the RF voltage, and/or the phase of the RF voltage. If the ion count is set at an optimized level (e.g., a maximized value or some other desired level such as a known level for the sample) and the FWHM 167 is set at the desired width, the tandem mass spectrometer 100 is placed in the operation mode at operation 176. If the ion count is not at an optimized level or the FWHM 167 is not set at a desired width, operations 170, 172 and 174 are repeated.

The computer continues to adjust the voltages applied to the electrode rods until the ion count at the frequency corresponding to the mass-to-charge ratio for ions of interest is optimized (i.e., the desired mass-to-charge ratio is centered at the apex of the peak or its centroid). This process is iterative. The computer 116 repeatedly sets the DC and RF voltages (including the voltage potentials, the frequency, and/or the phase) applied to the electrode rods 130 in the quadrupole mass ion filter 126 and then determines the ion count until the optimized ion count is realized. The ion count can be optimized for each mass-to-charge ratio. Alternatively, the total or aggregate ion count from all mass-to-charge ratios is optimized.

In an exemplary embodiment, the user can control the computer to select between one of several predetermined settings for the FWHM 167. Although setting the FWHM 167 is illustrated as being a part of operation 172, the computer can perform this operation at any time during the calibration process. In another possible embodiment, the FWHM 167 can be set when the tandem mass spectrometer 100 is in a state other than the calibration mode as described herein.

Additionally, the process of optimizing the counts can be done manually or automatically. If manually, the computer 116 displays the plot 160 on the monitor so that a user can see the ion counts. The user than interfaces with the computer 116 to adjust the DC and/or RF voltages and the computer 116 again displays the ion count plot 160. In alternative embodiments, the ion count is displayed in a format other than a plot. A table is an example of an alternative display format. Furthermore, the ion count data can be either displayed on a monitor or printed.

This process, or other calibration processes, also can be applied to other electrodes and components that affect the electric fields in the tandem mass spectrometer 100, including any component in the ion source 102, the first arrangement of ion optics 104, the collision cell 128, and the second arrangement of ion optics 108.

Figure 5A:
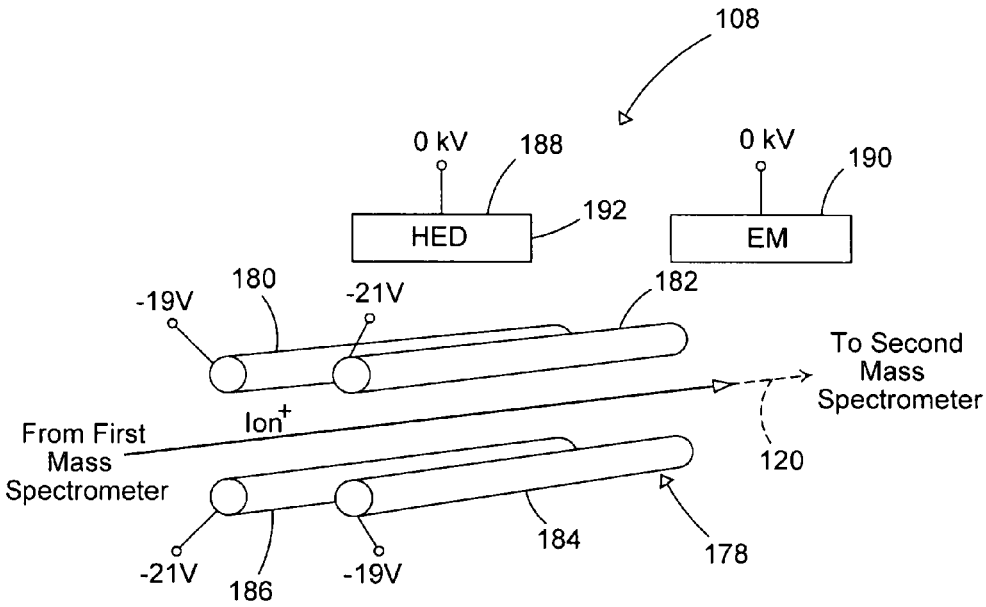
FIGS. 5A and 5B are block diagrams illustrating an alternative embodiment of the ions optics and ion detector positioned between the first and second mass analyzers.
Figure 5B:
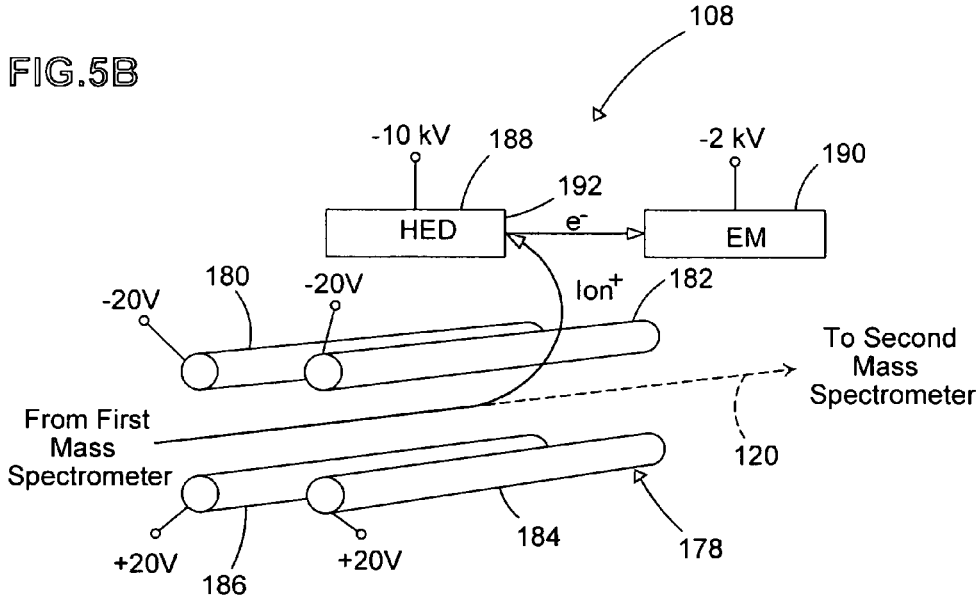

FIGS. 5A and 5B illustrate an alternative embodiment for the second arrangement of ion optics 108. FIG. 5A illustrates an exemplary embodiment of the second arrangement of ion optics 108 and the first detector 110 when the tandem mass spectrometer 100 is in an operation mode. FIG. 5B illustrates the second arrangement of ion optics 108 and the first detector 110 when the tandem mass spectrometer 100 is in a calibration mode.

The ion optics 108 includes a singlet 178 having a quadrupole arrangement of four electrode rods 180, 182, 184, and 186. The second detector is a Daly-type of detector having an HED 188 and an electron multiplier 190. The HED 188 is positioned between first and second electrodes 180 and 182 so there is an unobstructed path between the ion path 120 and the HED 188. The HED 188 is also positioned in an area on the outside of the electrode rods 180, 182, 184, and 186 relative to the ion path 120 to minimize any interference with the electric field generated by the electrode rods 180, 182, 184, and 186. The HED 188 has a downstream surface 192 that is orthogonal to the ion path 120 in the exemplary embodiment. The electron multiplier 190 is on the same side of the ion path 120 as the HED 188 and opposes the downstream surface 192.

In the exemplary embodiment, the first, second, third, and fourth electrodes 180, 182, 184, and 186 are positioned equidistantly around the ion path 120 at about 90° increments. The first and third electrodes 180 and 184, which are on opposite sides of the ion path 120, are energized with a first DC voltage such as −19 V. The second and fourth electrodes 182 and 186, which also are on opposite sides of the ion path 120, are energized with a first DC voltage such as −21 V. Other embodiments could also apply an RF voltage to the electrodes 180, 182, 184, and 186 to help propel the ion stream along the ion path 120.

When in the operational mode, as illustrated in FIG. 5A, there is no DC voltage or bias applied to either the HED 188 or the electron multiplier 190. In this mode, the ion stream passes along the ion path 120 from the first mass analyzer 106, through the singlet 178, and into the second mass analyzer 112.

When in the calibration mode as illustrated in FIG. 5B, the electrode rods switch from a first to a second state. Voltage potentials are applied to the HED 188 and the electron multiplier 190, which biases and excites them to generate an electric field. The voltage applied to the HED 188 (e.g., −10 kV) is greater than the voltage applied to the electron multiplier 190 (e.g., −2 kV). Additionally, a negative DC voltage is applied to the first and third electrodes 180 and 184, and a positive DC voltage is applied to the second and fourth electrodes 182 and 180. The electric field generated by the electrodes 180, 182, 184, and 186 and the HED 188 cause the ion stream to deflect from the ion path 120 and travel to and bombard the downstream surface 192 of the HED 188, which frees one or more electrons from the HED 188 and causes the electrons to flow from the HED 188 to the electron multiplier 190.

In the exemplary embodiment, −20 V are applied to first and third electrodes 180 are 184, and +20 V are applied to the second and fourth electrodes 182 and 180. Other embodiments can use different voltages or even use voltages of the same polarity. Yet other embodiments do not apply any voltage to the electrodes 180, 182, 184, and 186 and rely on the electric field generated by the HED 188 to deflect the ions from the ion path 120 to the HED 188.

Figure 6A:
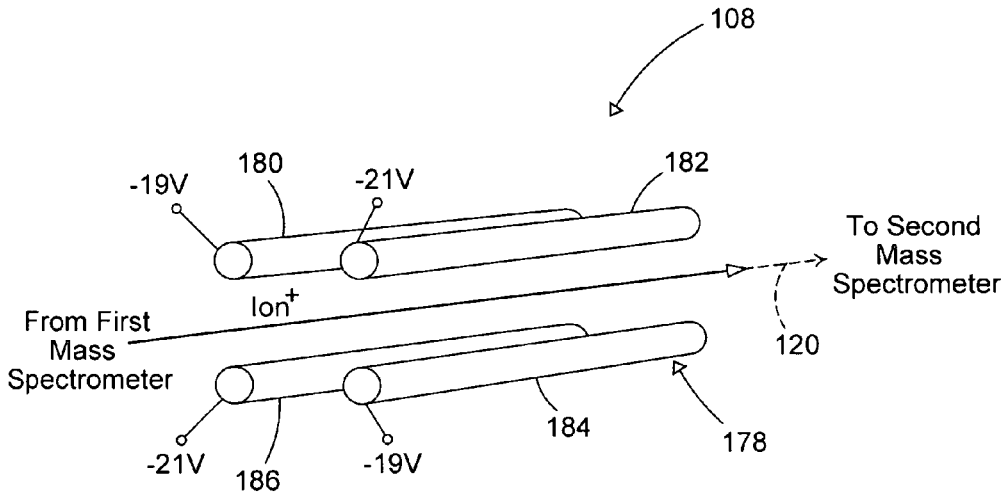
FIGS. 6A and 6B are block diagrams illustrating another alternative embodiment of the ions optics and ion detector positioned between the first and second mass analyzers.
Figure 6B:
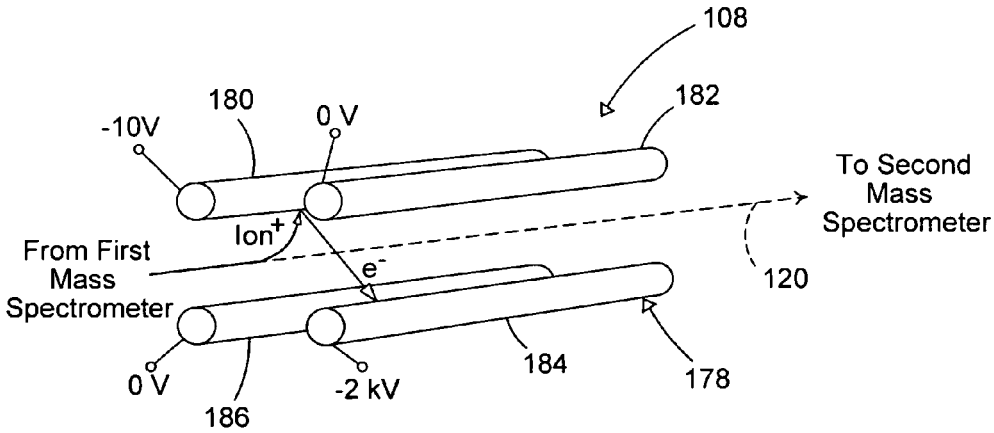

FIGS. 6A and 6B illustrate an alternative embodiment for the second arrangement of ion optics 108. FIG. 6A illustrates an exemplary embodiment of the second arrangement of ion optics 108 and the first detector 110 when the tandem mass spectrometer 100 is in an operation mode. FIG. 6B illustrates the second arrangement of ion optics 108 and the first detector 110 when the tandem mass spectrometer 100 is in a calibration mode.

This embodiment is substantially similar to the embodiment illustrated in FIGS. 5A and 5B, and operates the same way when in the operational mode.

When in the calibration mode, however, the first and third electrodes 180 and 184 function as in first detector 110. A first DC voltage is applied to the first electrode 180 (e.g., −10 kV) and a lower DC voltage is applied to the third electrode 184 (e.g., −2 kV). No voltage is applied to the second and fourth electrodes, 182 and 180 in the exemplary embodiment, although a voltage might be applied to the second and fourth electrodes 182 and 186 in alternative embodiments.

In this embodiment, the ions are deflected from the ion path 120 and strike the first electrode 180, which frees electrons and causes one or more electrons to flow from the first electrode 180 to the third electrode 184. The freed electrons bombard the third electrode 184 and induce a current in the third electrode 184. An electrometer measures the current and outputs signal that corresponds to the number of electrons, and hence the number of ions, detected.

Many alternative embodiments of the second arrangement of ion optics 108 and the first detector 110 are possible in addition to those disclosed herein. Alternative embodiments can include any type or configuration of electrodes and other structures that pass ions into the entrance of the second mass analyzer 139. Additionally, the first detector 110 can include any type of device other than an electron multiplier for detecting secondary electrons freed from the HED or for detecting particles other than electrons such as photons. Examples include a microchannel plates, Faraday cups, channel electron multipliers, scintillators, and photomultipliers. Yet other embodiments can include other types of detectors for detecting ions.

The exemplary embodiment illustrates the first detector 110 in certain location with respect to the second arrangement of ion optics 108. The first detector 110 can form a part of the second arrangement of ion optics 108, can be included in another component of the tandem mass spectrometer 100, or can form its own assembly included within the tandem mass spectrometer 100. Other embodiments can position the first detector 110 between the quadrupole mass ion filter 126 and the second mass analyzer 112 to receive ions deflected from the ion path 120. Yet other embodiments position the first detector 110 at any desired location along the ion path 120 before or upstream from the entrance 139 to the second mass analyzer 112.

The tandem mass spectrometer 100 in the exemplary embodiment is illustrated in an MS/MS mode in which the first mass analyzer 106 filters ions from the ion stream that are outside a selected range of mass-to-charge ratios. In other embodiments, the tandem mass spectrometer 100 also can be operated in an MS mode in which the quadrupole mass ion filter 126 passes all the ions from the sample to the second mass analyzer 112. In this mode, a DC voltage is not applied to the electrode rods 130 in the quadrupole mass ion filter 126, although an RF voltage may be applied to the electrode rods 130. In other possible embodiments, the tandem mass spectrometer 100 can have more than two mass spectrometers. For example, the tandem mass spectrometer 100 may have three mass spectrometers and be able to operate in an MS/MS/MS mode.

The various embodiments described above are provided by way of illustration only and should not be construed to limit the claims attached hereto. Those skilled in the art will readily recognize various modifications and changes that may be made without following the example embodiments and applications illustrated and described herein, and without departing from the true spirit and scope of the following claims.

The claims are:

1. A tandem mass spectrometer, comprising:

a first mass analyzer;

a second mass analyzer, the first and second mass analyzers forming an ion path, the second mass analyzer positioned downstream from the first mass analyzer and arranged to receive ions from the first mass analyzer; and an electrode system positioned between the first and second mass analyzers, the electrode system configured to selectively deflect ions away from the ion path for detection, wherein the detection occurs before the ions enter the second mass analyzer; and a structure positioned between the first mass analyzer and the electrode system, the structure generating collision fragments of some of the ions after the ions pass through the first mass analyzer.

2. The tandem mass spectrometer of claim 1, wherein the electrode system comprises an ion detector.

3. The tandem mass spectrometer of claim 2, wherein the ion detector comprises a electron detector.

4. The tandem mass spectrometer of claim 2, wherein the ion detector is a Daly-type ion detector.

5. The tandem mass spectrometer of claim 1, wherein the electrode system comprises an arrangement of electrode rods, the electrode rods being parallel to the ion path and positioned equidistantly around the path, the arrangement of electrode rods having first and second states, and wherein the arrangement of electrode rods form ion optics when in the first state; and at least two of the electrode rods in the arrangement of electrode rods form an ion detector when in the second state.

6. The tandem mass spectrometer of claim 1, wherein the first mass analyzer includes a multipole mass filter.

7. The tandem mass spectrometer of claim 6, wherein the multipole mass filter is a quadrupole mass filter.

8. A tandem mass spectrometer, comprising:

a first mass analyzer;

a second mass analyzer, the first and second mass analyzers forming an ion path, the second mass analyzer positioned downstream from the first mass analyzer and arranged to receive ions from the first mass analyzer; and an electrode system positioned between the first and second mass analyzers, the electrode system configured to selectively deflect ions away from the ion path for detection, wherein the detection occurs before the ions enter the second mass analyzer;

wherein the first mass analyzer includes a multipole mass filter; and wherein the first mass analyzer further comprises a collision cell positioned in series with and between the multipole mass filter and the second mass analyzer.

9. The tandem mass spectrometer of claim 8, wherein the electrode arrangement is positioned between the collision cell and the second mass analyzer.

10. A method of calibration adjusting a tandem mass spectrometer, the tandem mass spectrometer defining an ion path, the method comprising:

passing ions along an ion path from a first mass analyzer and toward a second mass analyzer;

intercepting ions with a structure that generates collision fragments of at least some of the ions after the ions leave the first mass analyzer;

selectively deflecting ions off the ion path and to an ion detector after the ions leave the structure and before they reach the second mass analyzer;

detecting an ion signal; and adjusting the first mass analyzer.

11. The method of claim 10, wherein an arrangement of at least four electrodes are positioned between the first and second mass analyzers, and selectively deflecting ions off the ion path and to an ion detector before they reach the second mass analyzer further comprises:

biasing at least two of the electrodes; and deflecting ions to one of the biased electrodes.

12. The method of claim 10, wherein the first mass analyzer includes an electrode arrangement and the act of adjusting the first mass analyzer includes adjusting at least one of the parameters selected from the group consisting of: a ratio between DC and RF voltage potentials applied to the electrode arrangement, a DC voltage potential applied to the electrode arrangement, an RF voltage potential applied to the electrode arrangement, a frequency of an RF voltage potential applied to the electrode arrangement, a phase of an RF voltage potential applied to the electrode arrangement, and combinations thereof.

13. A method of calibration adjusting a tandem mass spectrometer, the tandem mass spectrometer defining an ion path, the method comprising:

passing ions along an ion path from a first mass analyzer and toward a second mass analyzer;

selectively deflecting ions off the ion path and to an ion detector before they reach the second mass analyzer;

detecting an ion signal; and adjusting the first mass analyzer;

wherein selectively deflecting ions off the ion path and to an ion detector before they reach the second mass analyzer comprises biasing a conversion dynode.

14. The method of claim 13, wherein the conversion dynode is proximal to a plurality of electrode rods and the act of selectively deflecting ions off the ion path and to an ion detector before they reach the second mass analyzer further comprises biasing at least one of the electrode rods.

15. The method of claim 13, wherein detecting the ion signal includes:

deflecting ions to the conversion dynode;

receiving ions from the conversion dynode at the ion detector; and detecting the ion signal.

16. A method of calibration adjusting a tandem mass spectrometer, the tandem mass spectrometer defining an ion path, the method comprising:

passing ions along an ion path from a first mass analyzer and toward a second mass analyzer;

selectively deflecting ions off the ion path and to an ion detector before they reach the second mass analyzer;

detecting an ion signal; and adjusting the first mass analyzer;

wherein an arrangement of at least four electrodes are positioned between the first and second mass analyzers, and selectively deflecting ions off the ion path and to an ion detector before they reach the second mass analyzer further comprises:

biasing at least two of the electrodes; and deflecting ions to one of the biased electrodes;

wherein the arrangement of at least four electrodes is a singlet having a quadrupole arrangement of four electrode rods and biasing at least two of the electrodes further comprises biasing two electrode rods positioned on opposite sides of the ion path.

17. A method of calibration adjusting a tandem mass spectrometer, the tandem mass spectrometer defining an ion path, the method comprising:

passing ions along an ion path from a first mass analyzer and toward a second mass analyzer;

selectively deflecting ions off the ion path and to an ion detector before they reach the second mass analyzer;

detecting an ion signal; and adjusting the first mass analyzer;

further comprising repeating at least the following acts until the ion signal is optimized:

passing ions along an ion path from a first mass analyzer and toward a second mass analyzer;

selectively deflecting ions off the ion path and to an ion detector before they reach the second mass analyzer; and detecting an ion signal.

18. The method of claim 17, wherein the ion signal is optimized when the ion signal is a maximum value.

* * * * *